US009452546B2

(12) United States Patent
Kroll

(10) Patent No.: US 9,452,546 B2
(45) Date of Patent: Sep. 27, 2016

(54) METHOD AND PLANT FOR PRODUCING MATERIAL BOARDS, AND A DEVICE FOR COMPRESSING THE NARROW SIDES OF A PRESSED-MATERIAL MAT

(75) Inventor: Detlef Kroll, Eppingen (DE)

(73) Assignee: Dieffenbacher GmbH Maschinen-und Anlangenbau, Eppingen (DE)

( * ) Notice: Subject to any disclaimer, the term of this patent is extended or adjusted under 35 U.S.C. 154(b) by 230 days.

(21) Appl. No.: 14/116,227

(22) PCT Filed: May 27, 2012

(86) PCT No.: PCT/EP2012/059925

§ 371 (c)(1),
(2), (4) Date: Dec. 17, 2013

(87) PCT Pub. No.: WO2012/163867

PCT Pub. Date: Dec. 6, 2012

(65) Prior Publication Data

US 2014/0096887 A1 Apr. 10, 2014

(30) Foreign Application Priority Data

May 28, 2011 (DE) ..... 10 2011 076 655

(51) Int. Cl.

| | |
|---|---|
| ***B27N 3/10*** | (2006.01) |
| ***B27N 3/18*** | (2006.01) |
| ***B27M 1/08*** | (2006.01) |
| ***B27M 1/02*** | (2006.01) |

(Continued)

(52) U.S. Cl.

CPC ..... *B27M 1/08* (2013.01); *B27M 1/02* (2013.01); *B27N 3/10* (2013.01); *B27N 3/18* (2013.01); *B27N 3/183* (2013.01)

(58) Field of Classification Search

CPC ..... B27N 3/02; B27N 3/04; B27N 3/08; B27N 3/10; B27N 3/12; B27N 3/18; B27N 3/183; B29C 43/22; B29C 43/44; B29C 43/48; B29C 2043/483; B29C 66/834; B29C 66/8341; B29C 66/83421; B29C 66/83423

See application file for complete search history.

(56) References Cited

U.S. PATENT DOCUMENTS 2,165,280 A 7/1939 Lannan
3,096,227 A * 7/1963 Van Elten ..... B27N 3/10 156/378

(Continued)

FOREIGN PATENT DOCUMENTS

CN 1140122 A 1/1997
CN 1143764 C 3/2004

(Continued)

OTHER PUBLICATIONS

International Search Report dated Jul. 16, 2012 issued in connection with International Application No. PCT/EP2012/059925, with English translation.

(Continued)

*Primary Examiner* — Michael Tolin
(74) *Attorney, Agent, or Firm* — Foley & Lardner LLP

(57) ABSTRACT

A method for producing material panels includes scattering material onto a belt with a scattering device to form a mat to be compressed, and compressing narrow sides of the mat transversely to the production direction with a compaction device. A plant for producing material panels includes at least one compaction device arranged between a press and a scattering device and configured for compressing a mat by displacing narrow sides of the mat in the direction of the longitudinal central axis of the mat and/or by compressing a region adjoining the narrow sides of the surface side of the mat. A device for producing material panels includes at least one compaction device for compressing a mat by displacing narrow sides of the mat in the direction of the longitudinal central axis of the mat and/or by compressing a region adjoining the narrow sides of the surface side of the mat.

9 Claims, 4 Drawing Sheets

(56) References Cited

U.S. PATENT DOCUMENTS

| | | | | |
|---|---|---|---|---|
| 3,661,491 | A | 5/1972 | Troyer | |
| 4,067,678 | A | 1/1978 | Beranek, Jr. et al. | |
| 5,578,258 | A | 11/1996 | Grant et al. | |
| 6,464,914 | B1 * | 10/2002 | Graf | B27N 3/10 264/109 |
| 6,833,183 | B2 * | 12/2004 | Klasterka | B27N 3/14 428/221 |

FOREIGN PATENT DOCUMENTS

| | | | |
|---|---|---|---|
| CN | 101104289 | A | 1/2008 |
| CN | 101653959 | A | 2/2010 |
| DE | 198 58 096 | A1 | 6/2000 |

OTHER PUBLICATIONS

The State Intellectual Property Office of the People's Republic of China; Notice on the First Office Action on application 201280024605.3 dated Feb. 16, 2015.

The State Intellectual Property Office of the People's Republic of China; Notice on the Second Office Action on application 201280024605.3 dated Sep. 29, 2015.

The State Intellectual Property Office of the People's Republic of China; Notice on the Third Office Action on application 201280024605.3 dated Feb. 4, 2016.

European Patent Office action on application 12 724 139.6 dated Nov. 5, 2015.

* cited by examiner

METHOD AND PLANT FOR PRODUCING MATERIAL BOARDS, AND A DEVICE FOR COMPRESSING THE NARROW SIDES OF A PRESSED-MATERIAL MAT

Method and facility for producing material panels, such as chipboard, particle board, fiberboard, or similar wood-based panels and plastic panels and a device for compressing the narrow sides of a mat to be compressed.

CROSS REFERENCE TO RELATED APPLICATIONS

The present application is a U.S. National Stage of International Application No. PCT/EP2012/059925 filed on May 27, 2012, which claims the benefit of German Patent Application No. 10 2011 076 655.3 filed on May 28, 2011. The entire disclosures of which are incorporated herein by reference.

FIELD OF INVENTION

The invention relates to a method for producing material panels, such as chipboard, particle board, fiberboard, or similar wood-based panels and plastic panels, a facility for producing material panels, such as chipboard, particle board, fiberboard, or similar wood-based panels and plastic panels, and a device for compacting the narrow sides of a mat to be compressed in a facility for producing material panels, such as chipboard, particle board, fiberboard, or similar wood-based panels and plastic panels.

BACKGROUND INFORMATION

The production of at least partially wood-based chipboard or particleboard panels, for example, OSB or MDF panels, is existing prior art. In summary, during the production of oriented strand boards (OSB), various fractions are screened out from provided base material, pretreated, coated with glue, scattered uniformly by means of scattering machines onto a shaping belt, and compressed in presses (continuously or in cycles). Fiberboard (for example, MDF) is different therefrom, in the case of which the base material is typically macerated using steam in a refiner and broken down into relatively small fibrous material. The fundamental requirements of this technology have included for decades the optimum production and the transport of so-called mats on a shaping belt.

A device and a method for scattering particles to form a nonwoven material are known from DE 198 58 096 A1, in which it is described very extensively and in great detail how mats (nonwoven materials) are scattered, subsequently pretreated and transported, and compressed in a press, which operates continuously or in cycles. In particular, in this disclosure the details are also discussed of how a mat is optimally trimmed (continuously cut on the longitudinal sides) and also how different widths of a mat can be set and utilized in a facility for producing different batch sizes. In particular, it is emphasized that in addition to trimming, the mat can be guided on its longitudinal sides (narrow sides) with the aid of edge plates along the transport direction. Furthermore, it is disclosed that mats of different widths can be produced at a facility, if the trimming devices are displaceable and settable transversely to the transport direction. Fundamentally, the trimming and also the device and the method mentioned above as examples of the prior art have proven themselves.

In the course of the progress in the last decade and newly developed, better suitable gluing systems (adhesive liquors), steam presses have also increasingly come into use, inter alia. Also, greatly varying compaction and compression strategies for rapid and more effective compaction and deaeration of a mat have been introduced in the course thereof. It is also desired more and more often on the part of the facility operators for panel edges to have superelevated edge densities, in order to cause a certain edge stability with respect to impacts or also processing procedures in the produced panels. If an edge (density) superelevation is now set and scattered only in the scattering device (which possibly can also consist of a plurality of scattering devices), the edge superelevation is typically subsequently at least partially cut off again by a trimming device. The edge superelevations must be set to be correspondingly thick, to display an effect in the further production process. The large material quantity accompanying this, which must be recirculated back into the production circuit, is disadvantageous. In addition, the freshly trimmed narrow sides of a mat arc very susceptible to vibrations and transfers to continuing transport or shaping belts, however, so that in the case of a mat, the narrow sides typically have the appearances of disintegration upon reaching or passing through a preliminary press and/or the main press. The appearances of disintegration are even reinforced in the course of the compaction and/or steaming, if the optional preliminary press or a main press has a relatively steep compaction gradient, so that the excess air/steam between the compacted flat sides (surface top/bottom) must also only escape via the narrow sides and definitely blows out material from the narrow side of the mat during the deaeration procedure. In particular, severe disadvantages result for process variants if a narrow side is not embodied as sufficiently robust.

SUMMARY

The problem for a method to be provided and a facility, or device, respectively, to be provided is to treat a mat to be compressed in the course of the transport between a scattering station and a press in such a manner that the mats have, on at least one narrow side, fewer appearances of disintegration in the course of the production, and better results can be achieved in the case of various methods strategies in the course of the compression of such a mat.

The solution for the method is that the mat to be compressed, in the course of the transport to the press, is compacted on its narrow sides transversely to the production direction by means of a compaction device.

The solution to the problem for a facility is that, between the press and the scattering device, at least one compaction device is arranged for compacting the mat by displacing the narrow sides in the direction of the longitudinal center axis of the mat and/or by compacting a region of the flat side of the mat adjoining the narrow sides.

The solution for a device for compacting the narrow sides of a mat to be compressed in a facility for producing material panels, such as chipboard, particle board, fiberboard, or similar wood-based panels and plastic panels, having a press and at least one scattering device for preparing a mat to be compressed from scattered material is that, in the device, at least one means is arranged for compacting the mat by displacing the narrow sides in the direction of the longitudinal center axis of the mat and/or by compacting a region of the flat side of the mat adjoining the narrow sides.

The present invention preferably relates to the production of OSB material panels, but of course can also be applied in other production processes, for example, MDF, chipboard, or in the case of the production of fiberboard insulation mats and panels. Fiberboard insulation panels have been improved and redeveloped within the last decade, to become independent from plastic-containing base material, so that increasingly wood fibers having PMD containing adhesives or bicomponent fibers (gluing fibers having two different types of plastic, typically a plastic which can be melted and hardened again externally as a binder and a higher-melting-point plastic as a fiber-like but rigid binding element within the plate internally). The device or the facility is substantially suitable for carrying out the method, but can also be operated independently. It is also to be assumed that device-related features of the facility from the description are usable in the device and vice versa.

It has now advantageously been shown that the compaction of the narrow sides transversely to the transport direction (accompanied by a greater or lesser reduction of the original width B1 or B2 of the mat to be compressed to a width B3), the described appearances of disintegration on the narrow sides in the course of the transport, the deaeration, or active/passive fluidization are reduced. Active fluidization is understood, for example, as the introduction of steam, steam-air mixtures, and/or an application of pure hot air for heating the mat to be compressed and/or for activating the binder. Passive fluidization means here, inter alia, the use of a steam blast, which arises if a mat to be compressed having moisture comes into contact with means which transfer heat (heated or hot steel and fabric belts) or means which generate heat within the mat to be compressed (microwave, high-frequency) and therefore a steam front arises within the mat to be compressed, which preferably exits via the narrow sides. In particular in the case of these method applications, stable narrow sides are desired, which help to set a specific steam or fluid average pressure within the mat to be compressed, in particular during the compaction/compression/curing. A higher density narrow side in relation to the middle regions of the mat to be compressed (transversely to the production direction over the width) is accordingly advantageous, since a type of natural barrier is erected here.

The device/facility or the method can advantageously be designed as in the following exemplary embodiments: In a simple embodiment, a wheel, which is rotatable about a substantially vertical axis, is arranged on at least one narrow side of the mat to be compressed or above an edge region of the flat side. The invention understands the planar and axial alignment of the essential parts as follows: The mat to be compressed is scattered by means of a scattering device substantially horizontally and preferably on a moving and endlessly revolving shaping belt, wherein the mat to be compressed has two flat sides (one thereof in contact with the shaping belt) and two narrow sides, wherein the narrow sides run parallel to the production direction. The wheel, or its axis, respectively, is preferably set in relation to the mat to be compressed such that, as the mat to be compressed travels past, the surface of the narrow side is pressed and/or displaced in the direction of the longitudinal center of the mat, the mat is therefore reduced in its width and the density or the compaction, respectively, is increased in the edge region (on the narrow sides) of the mat. By way of the accompanying physical effects, in particular a higher adhesion effect between the individual particles, chips, fibers, or the like in the edge regions, in the further progression, the mat to be compressed, in particular during transport or during transfer from one conveyor belt to the next, has no or only very slight appearances of disintegration. Therefore, the contamination of the facility itself is advantageously also reduced. In a further embodiment, the circumferential surface of the wheel can be shaped or the axis of the wheel can have an angle to a vertical axis such that the upper, free flat side of the mat to be compressed is more strongly compressed than the flat side of the mat to be compressed resting on the shaping belt. In particular, however, it is preferably provided that the wheel is settable in the angle in both main axial directions, and therefore at least two differentiated angles and geometries are settable on the narrow sides of the mat to be compressed. The wheel preferably revolves freely by way of the friction arising on the mat to be compressed, but can also reasonably be driven, in particular in a regulated manner, depending on the material used in the mat to be compressed. It is optionally possible to set the circumference of the wheel synchronous to the production speed or even, depending on the desired effect, to rotate it faster or slower, so that the circumferential surface of the wheel rotates faster or slower than the mat to be compressed traveling past. The surface of the wheel can also be roughened or provided with steps, printed patterns, or the like in variations. A rubberized or friction-promoting surface is also conceivable, which preferably avoids displacements of the scattered material opposite to the production direction and displaces the scattered material of the mat to be compressed uniformly, preferably transversely to the production direction, in the direction of the longitudinal center axis of the mat to be compressed. A proven diameter in the case of OSB production (the scattered material, or the mat to be compressed, respectively, consists of oriented scattered scraps) is a diameter of the wheel of 0.5 m to 2 m. This size is also conceivable in the case of other scattered materials.

Fundamentally, however, it is also conceivable in the case of wheels driven in a regulated manner or compaction means for the edge compaction of the mat, to utilize compaction and/or displacement effects in or opposite to the production direction within the edge regions of the mat, to control or regulate the sequence of the compaction in the edge region in a targeted manner. For example, in the case of a more rapidly running wheel, the scattered material in the edge region can be pressed more against the scattered material passing by in the production direction, in order to obtain a further dynamically alternating degree of compaction in the sequence (in the production direction after the compaction device), which has a dynamic gradient of compaction in the course of the compaction (in the region of the compaction device) in a range between transversely to and in the production direction.

Depending on the production method or material used, it may still be reasonable to trim the narrow side before or after the compaction device. In this context, it would be advantageous if the trimming device were arranged together with the compaction device on an adjustment device, but still so they are settable differently from one another. Alternatively, the separate devices are to be settable in their spacing to the narrow sides of the mat to be compressed in order to ensure an optimum width setting of the mat and/or compaction of the narrow sides. In this context, one device is typically referred to, but preferably both narrow sides are equipped uniformly, so that a mat is reduced in its width by means of the compaction device and the narrow sides are compacted on both narrow sides, preferably simultaneously.

For more sensitive and/or higher quality scattered material, it can be conceivable to embody the compaction device as inclined baffle plates or baffle plates provided with a curve profile. Endlessly revolving compaction belts are also conceivable.

In the case of OSB production, it has proven itself if the edge regions of the mat are compacted in a length transversely to the production direction, which corresponds to approximately 75% of the length of a scrap (chip), preferably up to 50% of the length of a scrap.

Further advantageous measures and embodiments of the subject matter of the invention are disclosed in the subclaims and the following description with the drawing.

DETAILED DESCRIPTION OF VARIOUS EMBODIMENTS

Figure 1:
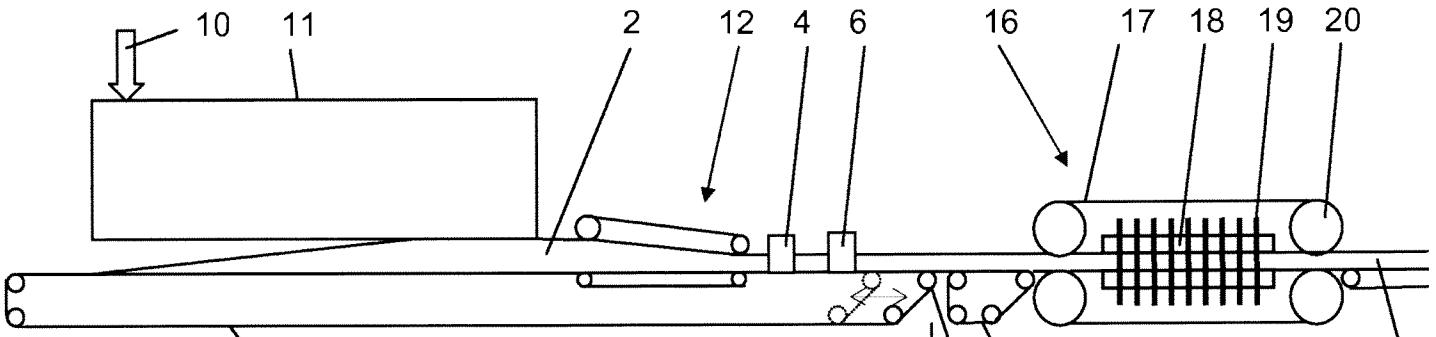
FIG. 1 shows a part of a facility for producing a material panel (without preliminary manufacturing and final manufacturing) in a schematic side view beginning with a scattering device above an endless shaping belt and a following continuously operating press.
Figure 2:
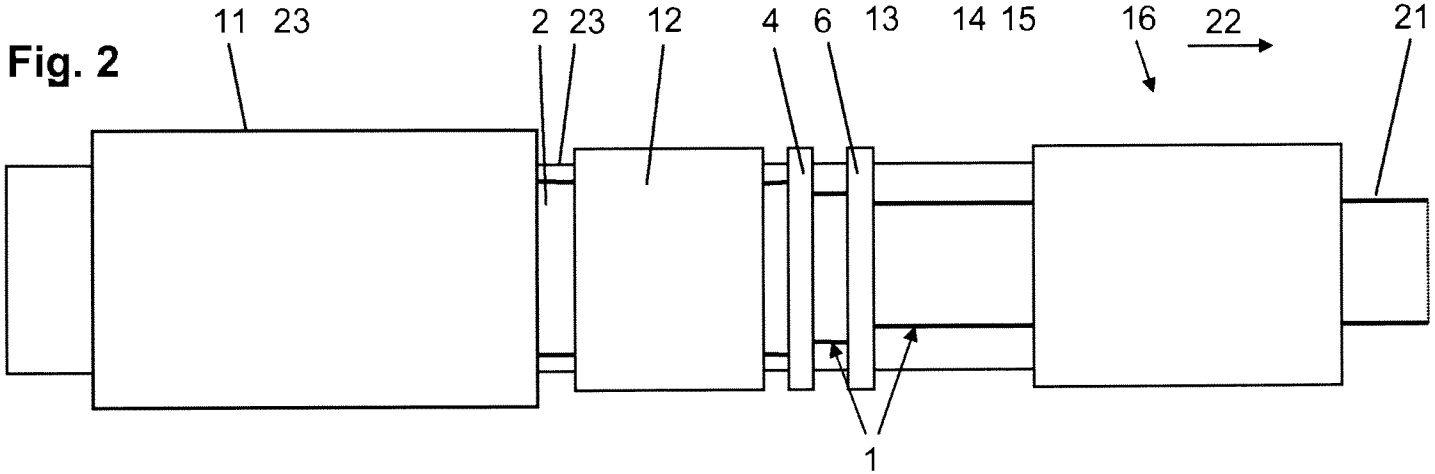
FIG. 2 shows a top view of the facility according to FIG. 1 and the exemplary preliminary compaction, trimming, and edge compaction of the mat before entering the press.

FIGS. 1 and 2 show a facility in a schematic view beginning with a scattering device 11 above an endless shaping belt 23 and a following continuously operating press 16. In the conventional production sequence, the scattering device 11 scatters the incoming scattered material 10 on the endless shaping belt 23 as a mat 2 to be compressed. Depending on the embodiment form or variant, the scattering device 11 can also comprise a scattered material bunker (not shown separately), wherein the supply of scattered material 10 and its treatment (preliminary manufacturing) will not be described further.

Depending on the application, the prepared mat 2 can experience a preliminary compaction and optionally still other preliminary treatments (for example, steaming, moistening) in a preliminary press 12 before it enters the press 16. Shortly before the press 16, a discard chute 13 is conventionally located, in which lower-quality or compromised mats 2 can be discarded by means of a reversible transfer lug 14. An intermediate conveyor 15, which is optimally aligned for the purpose of transferring the mat 2 to the continuously operating press 16, is typically located thereafter in the production direction 22. The continuously operating press 16 finally compresses, usually under the influence of temperature, the mat 2 to form a panel strand 21, which exits in cured form at the end of the press 16. The press 16 is preferably embodied as a double belt press, wherein the steel belts 17 are guided around deflection drums 20 and form a compression gap opposite one another in a compression frame 19 and via heating plates 18 supported therein. Reference is also made to the prior art with respect to the precise embodiments of continuously operating presses. It is also conceivable that a cyclic press is used here. In this case, the mat 2 is cut apart appropriately beforehand.

In the course of the invention, the mat 2 is now compacted by means of the compaction device 6 on the narrow sides and therefore obtains a lesser width transversely to the production direction 22. If the mat 2 is trimmed, compaction is not performed, but the width of the mat also becomes less, as shown as an example using a trimming device 4 mounted upstream in the production direction 22 and as shown in the top view of FIG. 2. The reduction in size of the mat 2 is not to scale but rather is shown exaggerated to illustrate the teaching of the invention.

Figure 3:
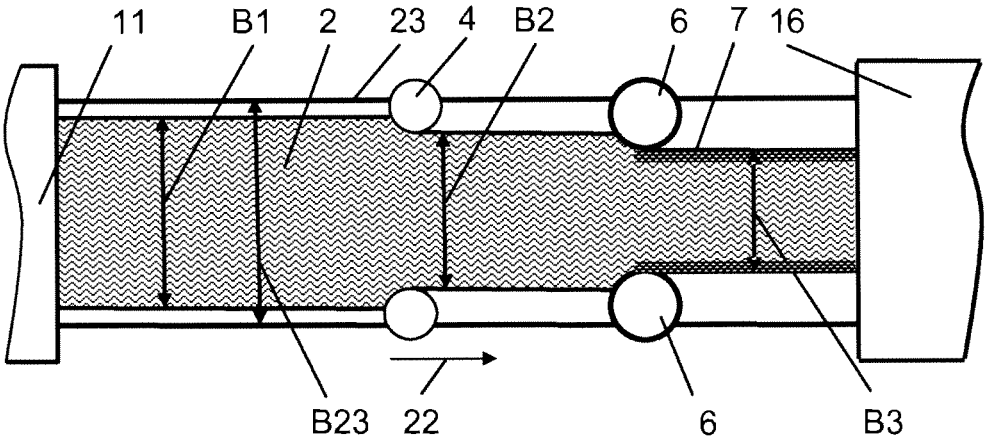
FIG. 3 shows an enlarged top view of an exemplary embodiment having a trimming device (milling machine) and an edge compaction by means of a compaction device (wheel) before the mat enters a press.

FIG. 3 is best described as essentially the method for producing material panels, such as chipboard, particle board, fiberboard, or similar wood-based panels and plastic panels, using a press 16 for scattered material 10, wherein a pressed material mat 2 made of the scattered material 10 is scattered by means of a scattering device 11 on an endlessly revolving shaping belt 23. The mat 2 is compacted transversely to the production direction 22 in the course of the transport to the press 16 by means of a compaction device 6 on its narrow sides 1. It is preferably provided that the narrow sides 1 are trimmed before the compaction device 6 in the production direction 22 using a trimming device 4. As shown, a revolving wheel 3, or also a baffle plate (not shown), or an endlessly revolving compaction belt 26 (see FIG. 7) can be used as the compaction device 6.

In particular, it is preferable for the compaction on the narrow sides 1 of the mat 2 to be carried out by displacing the narrow sides 1 in the direction of the longitudinal center axis of the mat 2 and/or by compacting a region of the flat side of the mat 2 adjoining the narrow sides 1. The latter is only shown indirectly in FIG. 3, because a compaction region 7 arises according to FIG. 3 in that the narrow sides are pressed in the direction of the longitudinal center axis and therefore an edge region, compaction region 7 here, arises which has a higher density. Alternatively or additionally, the edge region of the mat 2 can be compressed using similar means as described in this edge region using similar means from above, i.e., above the flat side, but adjoining the narrow side. In particular, it would be preferably executed that the compaction of a region, which adjoins the narrow sides 1, of the flat side of the mat 2 is carried out after the compaction on the narrow sides 1 of the mat 2 by displacing the narrow sides 1 in the direction of the longitudinal center axis of the mat 2. In this case, a multi-axial compaction results. In particular, however, an edge superelevation can be prevented from forming by way of the compaction of the edge region, which can have harmful effects in certain circumstances on the belt profile and/or other machine elements of the following preliminary press and/or the press. The edge region of elevated density and height is preferably adjusted back to the normal height of the untouched mat, or to even less than this.

FIG. 3 therefore overall shows a facility for producing material panels, such as chipboard, particle board, fiberboard, or similar wood-based panels and plastic panels, having a press 16 and at least one scattering device 11 for preparing a scattered mat 2 made of scattered material 10, in which, between the press 16 and the scattering device 11, at least one compaction device 6 is arranged for compacting the mat 2 by displacing the narrow sides 1 in the direction of the longitudinal center axis of the mat 2 and/or by compacting a region of the flat side of the mat 2 adjoining the narrow sides 1.

Figure 4:
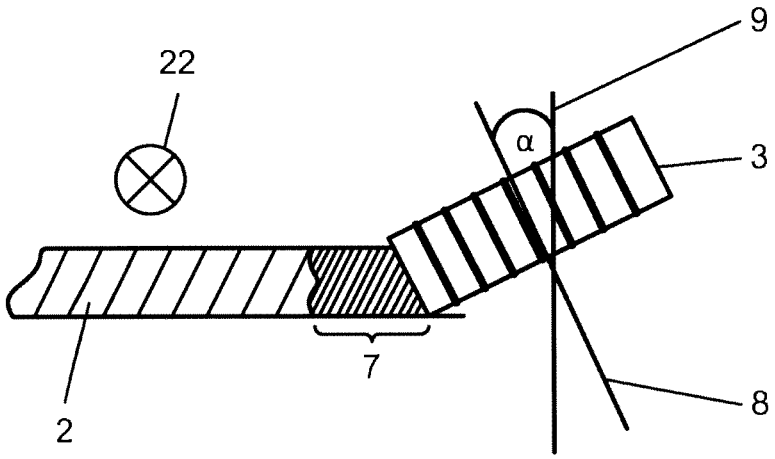
FIG. 4 shows, in a sectional view transversely to the production direction, a first setting angle ($\alpha$) of the compaction device to a vertical axis.
Figure 5:
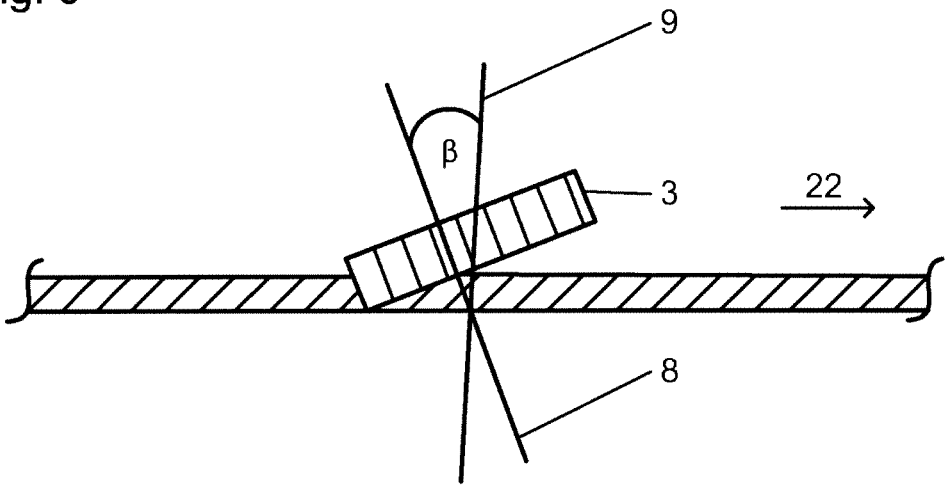
FIG. 5 shows, in a sectional view transversely to the production direction, a second setting angle ($\beta$) of the compaction device to a vertical axis.

According to FIGS. 4 and 5, the compaction device 6 is preferably adjustable at one of two angles α and β in relation to a vertical axis 9, wherein the angle α is aligned substantially transversely to the production direction 22 and the angle β is aligned substantially longitudinally to the production direction 22. The axis 9 is arranged vertically and the axis 8 is shown at the corresponding angle to the axis 9.

Figure 6:
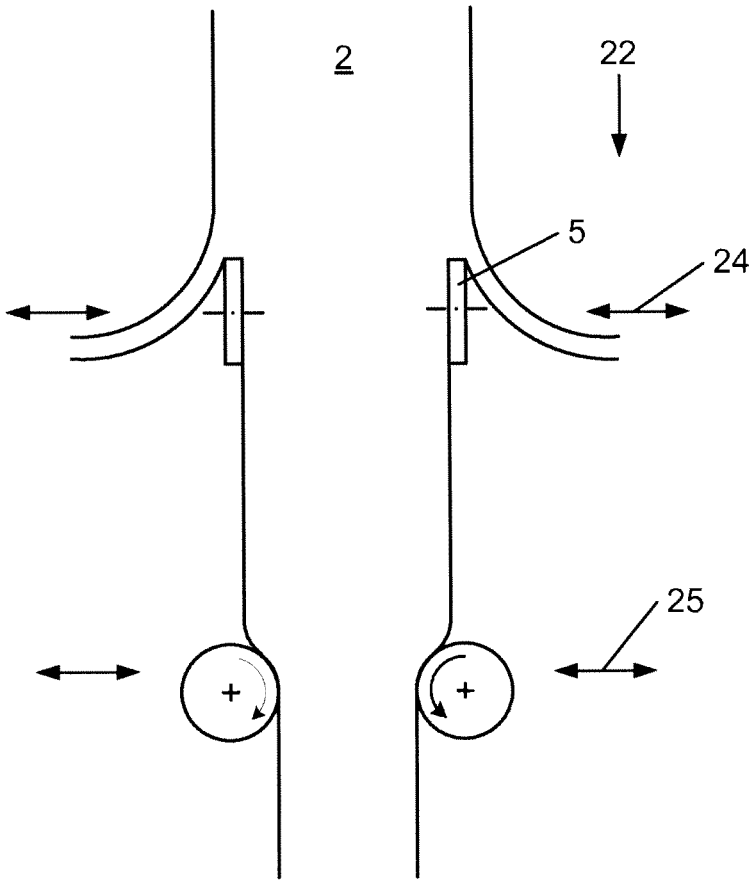
FIG. 6 shows a schematic top view of the effect of a trimming device arranged in the production direction and a compaction device.
Figure 7:
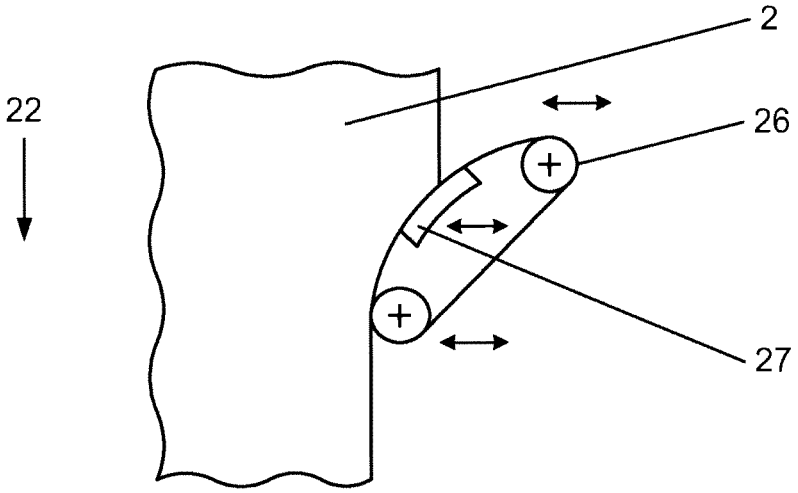
FIG. 7 shows a further exemplary embodiment of a possible compaction device having an endless belt of associated baffle plates.

As shown in FIGS. 6 and 7, the compaction device 6 and/or the trimming device 4 can be arranged so they are adjustable simultaneously and/or separately from one another by means of positioning devices 24/25. In addition, it is conceivable that the surfaces of the compaction device 6 coming into contact with the narrow sides 1 are substantially equipped with a high coefficient of friction, preferably rubberized or ridged. Overall, it is thus possible using a facility to arrange at least one device having at least one means for compacting the mat 2 by displacing the narrow sides 1 in the direction of the longitudinal center axis of the mat 2 and/or by compacting a region of the flat side of the mat 2 adjoining the narrow sides 1 in the direction of the shaping belt. Such a device for compacting a region of the flat side adjoining the narrow sides 1 is not shown once again for the sake of simplicity, it substantially corresponds to the described device, but is not arranged along a vertical axis but rather a horizontal axis, wherein the horizontal axis would be arranged transversely to the production direction and substantially parallel to the flat side of the mat 2. The corresponding setting possibilities of the angles α and β would still be provided and usable to perform an optimum compaction, of course.

As shown in FIGS. 6 and 7 by double arrows, in a preferred embodiment for any conceivable deformation geometries, the facility and the device have positioning devices 24 and 25, which allow a setting of the edge region, which is to be compacted or trimmed, on the narrow sides 1 of the mat 2. In the case of an endless compaction belt 26, it is conceivable to guide this over at least one contact pressure roll or a baffle plate 27 at the contact points with the narrow sides/flat sides.

LIST OF REFERENCE NUMERALS

1 narrow side
2 mat
3 wheel
4 trimming device
5 saw
6 compaction device
7 compaction region
8 axis (angled)
9 axis (vertical)
10 scattered material
11 scattering device
12 preliminary press
13 discard shaft
14 transfer lug (reversible)
15 intermediate conveyor
16 press
17 steel belts
18 heating plates
19 press frame
20 deflection drum
21 panel strand
22 production direction
23 shaping belt
24 positioning device
25 positioning device
26 compaction belt
27 baffle plate
α angle transversely to 22
β angle longitudinally to 22
B1 width of mat after 11
B2 width of mat after 4
B3 width of mat after 6
B23 width of shaping belt 23

The invention claimed is:

1. A method for producing material panels, the method comprising:

scattering scattered material with a scattering device on an endlessly revolving shaping belt to form a mat;

compacting the mat with a compaction device on narrow sides of the mat transverse to a production direction in the course of transporting the mat to a press to reduce an overall width of the mat along an entire height of the narrow sides; and pressing the mat with the press to produce a material panel.

2. The method according to claim 1, wherein the narrow sides are trimmed using a trimming device upstream of the compaction device in the production direction.

3. The method according to claim 1, wherein a revolving wheel is used as the compaction device.

4. The method according to claim 1, wherein the compaction device is configured to be set at one of two angles α and β with relation to a vertical axis, wherein the angle α is aligned substantially transversely to the production direction and the angle β is aligned substantially longitudinally to the production direction.

5. The method according to claim 1, wherein the compaction on the narrow sides of the mat is carried out by displacing the narrow sides in a direction of a longitudinal center axis of the mat and/or by compacting a region of a flat side of the mat adjoining the narrow sides.

6. The method according to claim 1, wherein the compaction of a region of a flat side of the mat adjoining the narrow sides is carried out after the compaction on the narrow sides of the mat by displacing the narrow sides in a direction of a longitudinal center axis of the mat.

7. The method according to claim 1, wherein baffle plates or an endlessly revolving compaction belt is used as the compaction device.

8. The method according to claim 1, wherein the material panel comprises chipboard, particle board, fiberboard, wood-based panels or plastic panels.

9. The method according to claim 1, wherein compacting the mat produces edge regions extending along the narrow sides, the edge regions having a density greater than a density of a center of the mat.

* * * * *